US008446215B2

(12) United States Patent
Nagata et al.

(10) Patent No.: US 8,446,215 B2
(45) Date of Patent: May 21, 2013

(54) CONSTANT VOLTAGE CIRCUIT

(75) Inventors: Toshihisa Nagata, Hyogo (JP); Hideki Agari, Osaka (JP); Kohji Yoshii, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 1085 days.

(21) Appl. No.: 11/653,872

(22) Filed: Jan. 17, 2007

(65) Prior Publication Data

US 2007/0115045 A1 May 24, 2007

Related U.S. Application Data

(63) Continuation of application No. 10/902,957, filed on Aug. 2, 2004, now Pat. No. 7,215,180.

(30) Foreign Application Priority Data

Aug. 7, 2003 (JP) ..... 2003-289101

(51) Int. Cl.
*G05F 1/10* (2006.01)

(52) U.S. Cl.
USPC ..... 327/541; 327/543

(58) Field of Classification Search
USPC ..... 327/538, 541, 543
See application file for complete search history.

(56) References Cited

U.S. PATENT DOCUMENTS

| | | | | |
|---|---|---|---|---|
| 5,444,595 | A | 8/1995 | Ishikawa et al. | |
| 5,642,252 | A | 6/1997 | Sakamoto et al. | |
| 6,429,631 | B2 * | 8/2002 | Inaba et al. | 323/277 |
| 6,879,501 | B2 | 4/2005 | Mori | |
| 7,049,879 | B2 * | 5/2006 | Osamura et al. | 327/419 |
| 2003/0128489 | A1 | 7/2003 | Katoh et al. | |

FOREIGN PATENT DOCUMENTS

| | | |
|---|---|---|
| JP | 03-154112 | 7/1991 |
| JP | 7-46291 | 5/1995 |
| JP | 2002-091580 | 3/2002 |
| JP | 2003-186554 | 7/2003 |

* cited by examiner

*Primary Examiner* — Long Nguyen
(74) *Attorney, Agent, or Firm* — Dickstein Shapiro LLP

(57) ABSTRACT

A constant voltage circuit is disclosed that includes an output control transistor and an overcurrent protection circuit. The overcurrent protection circuit includes a proportional current generation circuit part, a current division circuit part, a division ratio control circuit part, a current-voltage conversion circuit part, and an output current control circuit part. When the output voltage of the current-voltage conversion circuit part reaches a predetermined voltage, the output current control circuit part prevents an increase in the output current of the output control transistor so as to reduce a voltage output from an output terminal. When the voltage output from the output terminal is reduced to a predetermined limit voltage, the division ratio control circuit part changes the division ratio of the current division circuit part so that a current supplied to the current-voltage conversion circuit part increases so as to reduce the output current of the output control transistor.

3 Claims, 12 Drawing Sheets

CONSTANT VOLTAGE CIRCUIT

This application is a continuation of application Ser. No. 10/902,957, filed Aug. 2, 2004, now U.S. Pat. No. 7,215,180 which is hereby incorporated by reference in its entirety.

BACKGROUND OF THE INVENTION

1. Field of the Invention

The present invention relates generally to constant voltage circuits with an overcurrent protection circuit, and more particularly to a constant voltage circuit with an overcurrent protection circuit having a foldback characteristic.

2. Description of the Related Art

FIG. 1 is a circuit diagram showing a conventional constant voltage circuit 100 having an overcurrent protection circuit with a foldback characteristic. In the following, a description of a constant voltage generation operation in the constant voltage circuit 100 is omitted, and a description is given of the overcurrent protection circuit with a foldback characteristic.

Referring to FIG. 1, the source and the gate of a p-channel MOS (PMOS) transistor M42 are connected to the source and the gate, respectively, of a PMOS transistor M41 forming a driver transistor controlling an output current iout. A drain current output from the drain of the PMOS transistor M42 is proportional to the drain current of the PMOS transistor M41.

The drain current of the PMOS transistor M42 is input to a current division circuit composed of PMOS transistors M44 and M45. The sources of the PMOS transistors M44 and M45 are connected, and the gates of the PMOS transistors M44 and M45 are connected. Accordingly, the drain current of the PMOS transistor M42 is divided into current values that are proportional to the transistor sizes of the PMOS transistors M44 and M45, and output from the PMOS transistors M44 and M45 as their respective drain currents.

The drain current of the PMOS transistor M44 flows through a resistor R53 to generate voltage across the resistor R53. When the voltage reaches the threshold voltage of an n-channel MOS (NMOS) transistor M49, the NMOS transistor M49 is turned on to switch on a PMOS transistor M43. The drain of the PMOS transistor M43 is connected to the gate of a PMOS transistor M41. Accordingly, the PMOS transistor M43 is turned on so as to raise the gate voltage of the PMOS transistor M41, so that an increase in the current iout output from the PMOS transistor M41 is controlled. As a result, the output voltage Vout of the constant voltage circuit 100, which is the voltage of an output terminal from which the current iout is output, is reduced.

The connection of resistors R51 and R52 for detecting the output voltage Vout is connected to the gate of a PMOS transistor M54, which forms an input end of a differential amplifier circuit composed of PMOS transistors M53 and M55 through M57, the PMOS transistor M54, a resistor R54, and a capacitor C51. A resistor R55 is connected between the gate of the PMOS transistor M55, which forms the other input end of the differential amplifier circuit, and a negative side supply voltage Vss. A current is supplied to the resistor R55 from a positive side supply voltage Vdd via PMOS transistors M58 and M59. Accordingly, a predetermined voltage is applied to the gate of the PMOS transistor M55.

In the differential amplifier circuit, the gate voltage of the PMOS transistor M54 is set to be higher than the gate voltage of the PMOS transistor M55 when the output voltage Vout is a predetermined voltage. When the output current iout becomes an overcurrent and flows so that the output voltage Vout is reduced, the voltage at the connection of the resistors R51 and R52 detecting the output voltage Vout is also reduced so that the gate voltage of the PMOS transistor M54 is reduced. When the gate voltage of the PMOS transistor M54 becomes lower than the gate-voltage of the PMOS transistor M55, the drain current of the PMOS transistor M54 increases so that the drain voltage of the PMOS transistor M54 increases. Since the gate of an NMOS transistor M51 is connected to the drain of the PMOS transistor M54, the NMOS transistor M51 is turned on.

When the NMOS transistor M51 is turned on, a PMOS transistor M50, which is connected to the drain of the NMOS transistor M51, is turned on. The PMOS transistor M50 forms a current mirror circuit with a PMOS transistor M52, and the PMOS transistor M52 is also turned on. The drain of the PMOS transistor M52 is connected to the gate of the PMOS transistor M41. Accordingly, when the PMOS transistor M52 is turned on, the gate voltage of the PMOS transistor M41 increases so that the drain current of the PMOS transistor M41, that is, the output current iout, is reduced. The characteristic showing the relationship between the output voltage Vout and the output current iout is a foldback characteristic as shown in FIG. 2.

For instance, according to a technique disclosed in Japanese Examined Patent Publication No. 7-46291, in the case of a decrease in output voltage due to a load short circuit or a half short, the decrease is detected in a voltage detection circuit, and an operations signal is provided from a protection circuit to a current limit circuit based on a detection signal. As a result, the current limit circuit outputs a stop signal to a control unit, so that a switching element, supplying a load with current, is maintained in a non-conducting state.

In these years, there has been a demand for power-saving electronic apparatuses, and there has also been a strong demand for a power supply circuit forming a constant voltage circuit that consumes less current. Accordingly, there has been a demand for reduction in current consumption of a protection circuit provided in the constant voltage circuit.

However, as shown in FIG. 1, the conventional overcurrent protection circuit employs a differential amplifier circuit. Therefore, when a bias current set by the PMOS transistor M53 is reduced to decrease current consumption of the differential amplifier circuit, the speed of response of the differential amplifier circuit is reduced so that it is difficult to perform phase compensation.

Inappropriate phase compensation causes a problem in that the differential amplifier circuit operates unstably to oscillate in a region where the output current iout decreases as the output voltage Vout decreases in FIG. 2. The phase compensation of the differential amplifier circuit may be performed to some extent by changing the time constants of the resistor R54 and the capacitor C51. However, it is impossible to reduce the bias current to near zero.

SUMMARY OF THE INVENTION

Accordingly, it is a general object of the present invention to provide a constant voltage circuit in which the above-described disadvantages are eliminated.

A more specific object of the present invention is to provide a constant voltage circuit including an overcurrent protection circuit that can reduce current consumption while having a characteristic approximating the conventional foldback characteristic.

The above objects of the present invention are achieved by a constant voltage circuit, including: an output control transistor configured to control a current output from a predetermined output terminal so that a voltage output from the output terminal remains constant at a predetermined value; and an overcurrent protection circuit configured to control an operation of the output control transistor so as to prevent an output current of the output control transistor from exceeding a predetermined value, wherein the overcurrent protection circuit includes a proportional current generation circuit part configured to generate and output a current proportional to the output current of the output control transistor, a current division circuit part configured to divide the output current of the proportional current generation circuit part in a predetermined division ratio, a division ratio control circuit part configured to control the division ratio of the current division circuit part, a current-voltage conversion circuit part configured to convert a predetermined one of divided currents obtained as a result of dividing the current in the current division circuit part into a voltage and output the voltage, and an output current control circuit part configured to perform output current control on the output control transistor in accordance with the output voltage of the current-voltage conversion circuit part, wherein when the output voltage of the current-voltage conversion circuit part reaches a predetermined voltage, the output current control circuit part controls an increase in the output current of the output control transistor so as to reduce the voltage output from the output terminal, wherein when the voltage output from the output terminal is reduced to a predetermined first limit voltage, the division ratio control circuit part changes the division ratio of the current division circuit part so that the current supplied to the current-voltage conversion circuit part increases so as to reduce the output current of the output control transistor.

The above objects of the present invention are also achieved by a constant voltage circuit generating and outputting a predetermined constant voltage, the constant voltage circuit having an overcurrent protection function that upon detecting that an output current reaches a predetermined current limit reduces an output voltage and the output current in a step-like manner by alternately reducing the output voltage by a predetermined voltage and then the output current by a predetermined current, each reduction step corresponding to a change in output voltage followed by a change in output current, wherein when the overcurrent protection function operates, the output voltage and the output current are alternately reduced at different times to reduce heat dissipation with impacting operating characteristics of the circuit.

The above objects of the present invention are also achieved by a constant voltage circuit generating and outputting a predetermined constant voltage, the constant voltage circuit having an overcurrent protection function that upon detecting that an output current reaches a predetermined current limit reduces an output voltage and the output current in a step-like manner by alternately reducing the output voltage by a predetermined voltage and then the output current by a predetermined current, each reduction step corresponding to a change in output voltage followed by a change in output current, wherein when the overcurrent protection function operates, a reduction in the output voltage of a first reduction step is less than a reduction in the output voltage of a subsequent reduction step.

The above objects of the present invention are also achieved by a constant voltage circuit, including: an output control transistor configured to control a current output from a predetermined output terminal so that a voltage output from the output terminal remains constant at a predetermined value; and an overcurrent protection circuit configured to control an operation of the output control transistor so as to prevent an output current of the output control transistor from exceeding a predetermined value, wherein the overcurrent protection circuit includes a proportional current generation circuit part configured to generate and output a current proportional to the output current of the output control transistor, a current division circuit part configured to divide the output current of the proportional current generation circuit part in a predetermined division ratio, a current-voltage conversion circuit part configured to convert a predetermined one of divided currents obtained as a result of dividing the current in the current division circuit part into a voltage and output the voltage, a conversion ratio changing circuit part configured to change a current-voltage conversion ratio of the current-voltage conversion circuit part in accordance with the voltage output from the output terminal, and an output current control circuit part configured to perform output current control on the output control transistor in accordance with the output voltage of the current-voltage conversion circuit part, wherein when the output voltage of the current-voltage conversion circuit part reaches a predetermined voltage, the output current control circuit part controls an increase in the output current of the output control transistor so as to reduce the voltage output from the output terminal, wherein the conversion ratio changing circuit part, in accordance with a decrease in the voltage output from the output terminal, changes the current-voltage conversion ratio of the current-voltage conversion circuit part so as to reduce the output current of the output control transistor.

According to the present invention, a constant voltage circuit may be provided with an overcurrent protection circuit with the limiting characteristic of an output voltage and current approximating the conventional foldback characteristic, the overcurrent protection circuit achieving low current consumption and being free of unstable operations such as oscillation.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Next, a description is given, with reference to the accompanying drawings, of embodiments of the present invention.

First Embodiment

Figure 1:
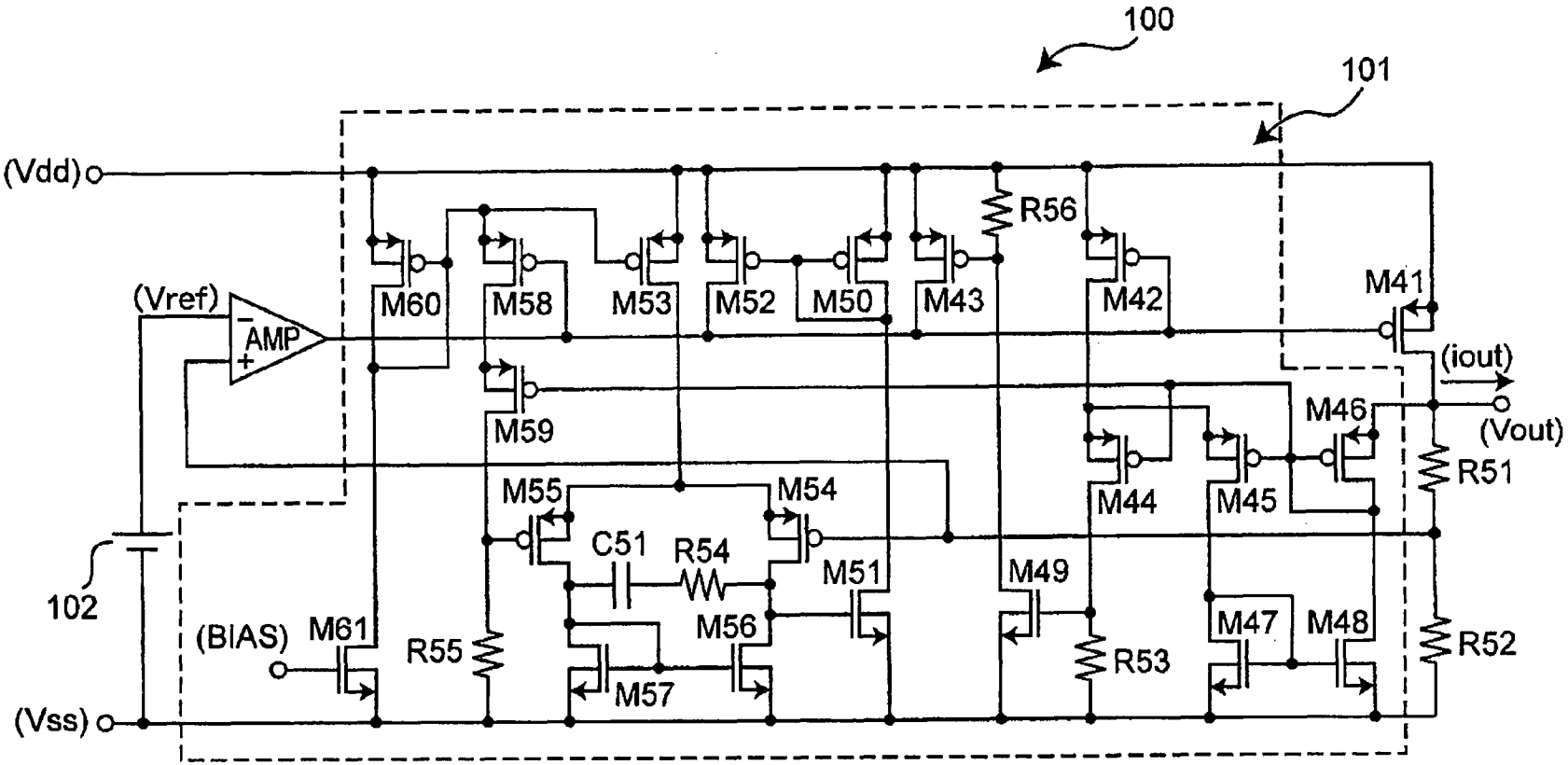
FIG.1 PRIOR ART
FIG. 1 is a circuit diagram showing a conventional constant voltage circuit having an overcurrent protection circuit with a foldback characteristic.
Figure 2:
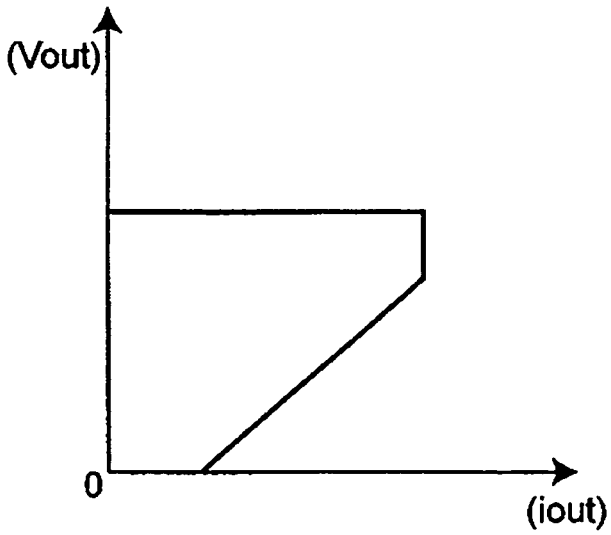
FIG.2 PRIOR ART
FIG. 2 is a graph showing an output voltage-current relationship of the constant voltage circuit of FIG. 1.
Figure 3:
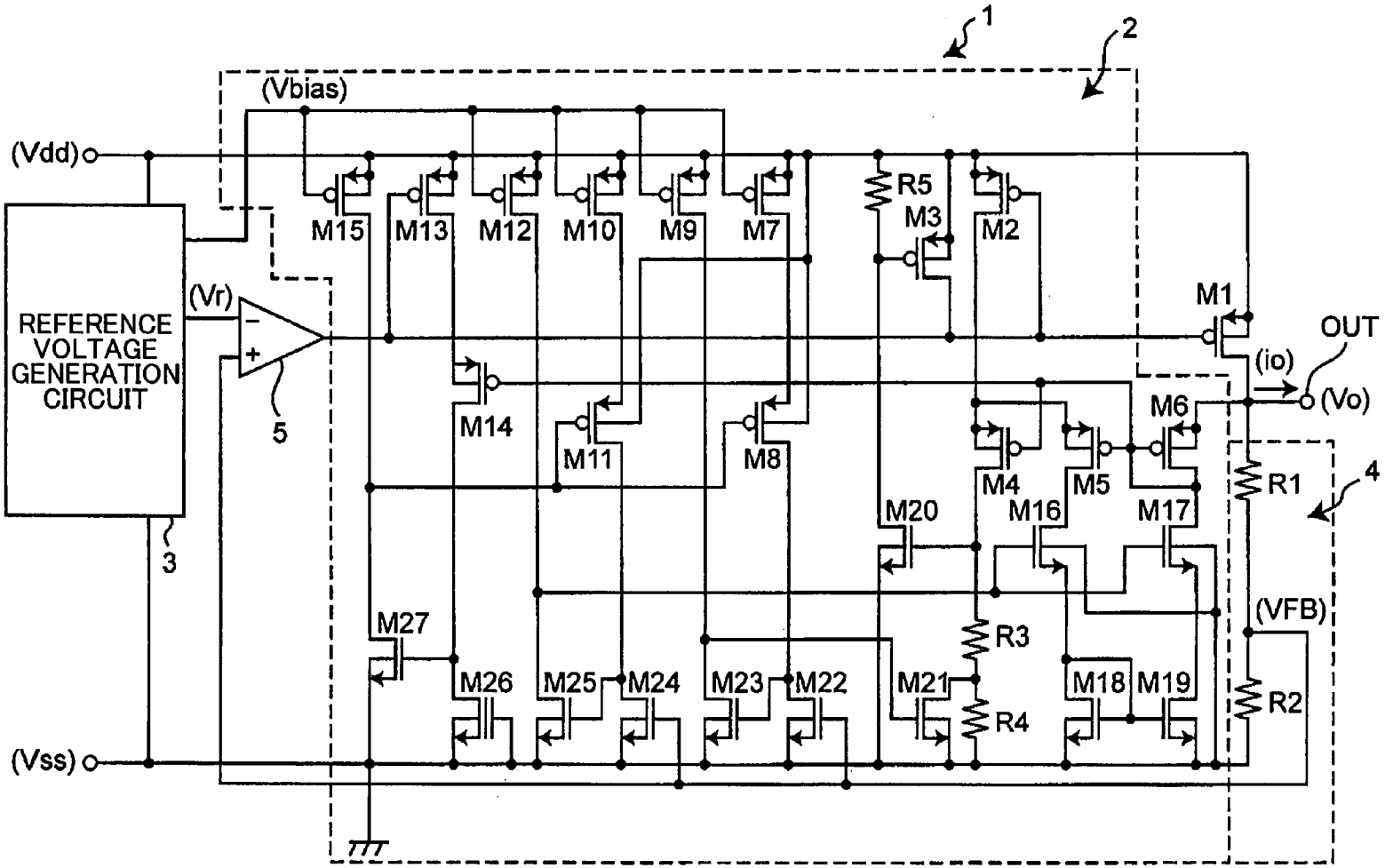
FIG. 3 is a circuit diagram showing a constant voltage circuit according to a first embodiment of the present invention.

FIG. 3 is a circuit diagram showing a constant voltage circuit 1 according to a first embodiment of the present invention.

Referring to FIG. 3, the constant voltage circuit 1 controls an output current io output from an output terminal OUT so that an output voltage Vo output from the output terminal OUT remains constant at a predetermined voltage. The constant voltage circuit 1 includes an overcurrent protection circuit 2 for the output current io. The overcurrent protection circuit 2 operates so that the relationship between the output voltage Vo and the output current io has a characteristic approximating the conventional foldback characteristic.

The constant voltage circuit 1 includes the overcurrent protection circuit 2, a reference voltage generation circuit 3 generating and outputting a predetermined reference voltage Vr, an output voltage detection circuit 4 dividing the output voltage Vo between resistors R1 and R2 and outputting a resultant divided voltage VFB, an error amplifier 5 amplifying and outputting a difference in voltage between the divided voltage VFB output from the output voltage detection circuit 4 and the reference voltage Vr, and a PMOS transistor M1 forming a driver transistor controlling the output current io based on the output signal of the error amplifier 5 so that the output voltage Vo is controlled to a constant voltage. The overcurrent protection circuit 2 includes PMOS transistors M2 through M15, NMOS transistors M16 through M27, and resistors R3 through R5.

The PMOS transistor M1 forms a transistor for output control (an output control transistor). The resistors R1 and R2 form the output voltage detection circuit 4. The PMOS transistor M2 forms a proportional current generation circuit part. The PMOS transistors M4 and M5 form a current division circuit part. The PMOS transistor M10 and M12 and the NMOS transistors M16, M24, and M25 form a division ratio control circuit part. The resistors R3 and R4 form a current-voltage conversion circuit part. The PMOS transistor M3, the NMOS transistor M20, and the resistor R5 form an output current control circuit part. The PMOS transistors M7 and M9 and the NMOS transistors M21 through M23 form a conversion ratio changing circuit part. The NMOS transistor M22 forms a fourth transistor. The NMOS transistor M24 forms a third transistor.

The PMOS transistor M1 is connected between a positive side supply voltage Vdd and the output terminal OUT. A series circuit formed of the resistors R1 and R2 is connected between the output terminal OUT and a negative side supply voltage Vss. The connection of the resistors R1 and R2 is connected to the non-inverting input terminal of the error amplifier 5. The reference voltage Vr is applied to the inverting input terminal of the error amplifier 5. The output terminal of the error amplifier 5 is connected to the gate of the PMOS transistor M1. The error amplifier 5 controls the operation of the PMOS transistor M1 so that the divided voltage VFB is equalized with the reference voltage Vr, thereby controlling the output current io so that the output voltage Vo is controlled to a constant voltage.

The source of the PMOS transistor M2 is connected to the source of the PMOS transistor M1, and the gate of the PMOS transistor M2 is connected to the gate of the PMOS transistor M1. Accordingly, a current proportional to the drain current of the PMOS transistor M1 flows from the drain of the PMOS transistor M2. The drain current of the PMOS transistor M2 is supplied to the source of each of the PMOS transistors M4 and M5 in a current mirror circuit composed of the PMOS transistors M4 and M5 and a PMOS transistor M6. Thus, the drain current of the PMOS transistor M2 is divided into currents proportional to the transistor sizes of the PMOS transistors M4 and M5, and the divided currents are output from the PMOS transistors M4 and M5 as their respective drain currents.

The drain current of the PMOS transistor M4, which is one of the divided currents, is supplied to the resistors R3 and R4 connected in series. The NMOS transistor M21, which is normally turned on, is connected in parallel to both ends of the resistor R4 so as to be short-circuited. The connection of the resistor R3 and the drain of the PMOS transistor M4 is connected to the gate of the NMOS transistor M20. When the voltage across the series circuit of the resistors R3 and R4 is equalized with the threshold voltage of the NMOS transistor M20, the NMOS transistor M20 is turned on.

The gate of the PMOS transistor M3 is connected to the drain of the NMOS transistor M20. Accordingly, when the NMOS transistor M20 is turned on, the PMOS transistor M3 is also turned on. The source of the PMOS transistor M3 is connected to the source of the PMOS transistor M1, and the drain of the PMOS transistor M3 is connected to the gate of the PMOS transistor M1. Accordingly, when the PMOS transistor M3 is turned on, the gate voltage of the PMOS transistor M1 is controlled so as to prevent an increase in the output current io so that the output voltage Vo is reduced.

Figure 4:
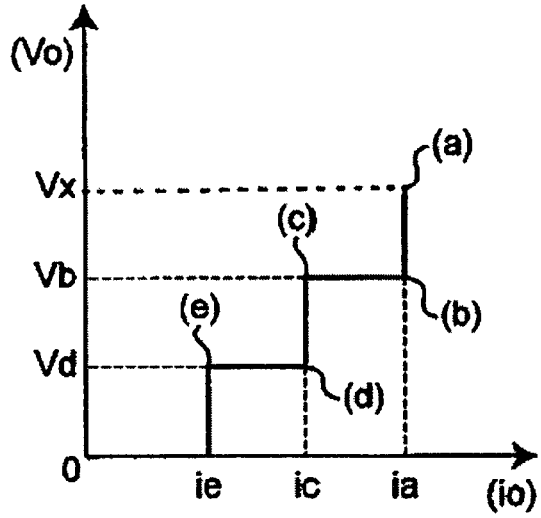
FIG. 4 is a graph showing an output voltage-current relationship in the constant voltage circuit according to the first embodiment of the present invention.

This state is shown as Point (a) in FIG. 4, which shows the relationship between the output voltage Vo and the output current io. That is, when the output current io reaches a first limit current value ia, the NMOS transistor M20 is turned on, and the overcurrent protection circuit 2 controls the operation of the PMOS transistor M1 so that the output current io is limited to the first limit current value ia by the PMOS transistor M3. As a result, the output voltage Vo is reduced.

On the other hand, the divided voltage VFB is applied to the gate of the NMOS transistor M24. The NMOS transistor M24 is increased in transistor size. While the constant voltage circuit 1 is operating normally, the divided voltage VFB is controlled so as to be equalized with the reference voltage Vr. Accordingly, in this state, the NMOS transistor M24 is turned on. The divided voltage VFB is reduced with a decrease in the output voltage Vo, and when the output voltage Vo is reduced to a voltage Vb at Point (b) in FIG. 4, the NMOS transistor M24 is turned off. That is, the NMOS transistor M24 forms a transistor for detecting the first limit voltage Vb.

The drain of the NMOS transistor M24 is connected to the gate of the NMOS transistor M25. Accordingly, when the NMOS transistor M24 is turned off, the NMOS transistor M25 is turned on so that the drain voltage of the NMOS transistor M25 is reduced. The drain of the NMOS transistor M25 is connected to the gate of each of the NMOS transistors M16 and M17. Accordingly, the NMOS transistors M16 and M17 are turned off.

When the NMOS transistor M16 is turned off, the current channel of the drain current of the PMOS transistor M5, which divides the drain current of the PMOS transistor M2 proportional to the output current io, is cut off. Accordingly, all the drain current of the PMOS transistor M2 flows into the PMOS transistor M4. As a result, the voltage across the resistor R3 increases so as to increase the drain current of the NMOS transistor M20, so that the gate voltage of the PMOS transistor M3 is reduced. As a result, the gate voltage of the PMOS transistor M1 increases so that the output current io is reduced. This state is shown as Point (c) in FIG. 4. That is, when the output current io reaches a current value ic, the NMOS transistor M16 is turned off, and the overcurrent protection circuit 2 controls the operation of the PMOS transistor M1 so that the output current io is limited to the second limit current value ic by the PMOS transistor M3. As a result, the output voltage Vo is reduced.

The divided voltage VFB is applied to the gate of the NMOS transistor M22. The NMOS transistor M22 has a larger transistor size or a lower threshold voltage than the NMOS transistor M24. Like the NMOS transistor M24, the NMOS transistor M22 is turned on while the constant voltage circuit 1 is operating normally. The divided voltage VFB is reduced with a decrease in the output voltage Vo, and when the output voltage Vo is reduced to a voltage Vd at Point (d) in FIG. 4, the NMOS transistor M22 is turned off. That is, the NMOS transistor M22 forms a transistor for detecting the second limit voltage Vd.

The drain of the NMOS transistor M22 is connected to the gate of the NMOS transistor M23. Accordingly, when the NMOS transistor M22 is turned off, the NMOS transistor M23 is turned on so that the drain voltage of the NMOS transistor M23 is reduced. The drain of the NMOS transistor M23 is connected to the gate of the NMOS transistor M21. Accordingly, the NMOS transistor M21 is turned off.

When the NMOS transistor M21 is turned off, the drain current of the PMOS transistor M2, which has been flowing into only the resistor R3, also flows into the resistor R4. Accordingly, the gate voltage of the NMOS transistor M20 increases so as to increase the gate voltage of the PMOS transistor M1 via the NMOS transistor M20 and the PMOS transistor M3. As a result, the output current io is reduced. This state is shown as Point (e) in FIG. 4. That is, when the output current io reaches a current value ie, the NMOS transistor M21 is turned off, and the overcurrent protection circuit 2 controls the operation of the PMOS transistor M1 so that the output current io is limited to the third limit current value ie by the PMOS transistor M3. As a result, the output voltage Vo is reduced. Thus, when the output current io of the constant voltage circuit 1 becomes as large as the first limit current ia, the output voltage Vo and the output current io are reduced in a step-like manner with a characteristic substantially equal to the conventional foldback characteristic.

Next, a description is given of the starting of the operation of the overcurrent protection circuit 2.

The NMOS transistor M26 is a depletion-type MOS transistor. The gate of the NMOS transistor M26 is connected to ground. Accordingly, the NMOS transistor M26 operates so that a predetermined drain current flows. The drain of the NMOS transistor M26 is connected to the gate of the NMOS transistor M27 and the drain of the PMOS transistor M14 the drain of the PMOS transistor M13 is connected to the source of the PMOS transistor M14.

The source of the PMOS transistor M13 is connected to the source of the PMOS transistor M1, and the gate of the PMOS transistor M13 is connected to the gate of the PMOS transistor M1. Accordingly, the drain current of the PMOS transistor M13 is proportional to the output current io. The drain current of the PMOS transistor M13 flows through the PMOS transistor M14 for setting a bias voltage to become the drain current of the NMOS transistor M26.

When the output current io of the constant voltage circuit 1 reaches the predetermined current value ia, the drain voltage of the NMOS transistor M26 exceeds the threshold voltage of the NMOS transistor M27 so that the NMOS transistor M27 is turned on. When the NMOS transistor M27 is turned on, the PMOS transistors M8 and M11, whose gates are connected to the drain of the NMOS transistor M27, are turned on. As a result, the drain of the NMOS transistor M22 and the drain of the NMOS transistor M24 are connected to the PMOS transistors M7 and M10, which are current sources, respectively, so that the NMOS transistors M22 and M24 function. Each of the PMOS transistors M7, M9, M10, M12, and M15 forms a constant current source. A predetermined bias voltage Vbias is applied from the reference voltage generation circuit 3 to the gate of each of the PMOS transistors M7, M9, M10, M12, and M15.

Figure 5:
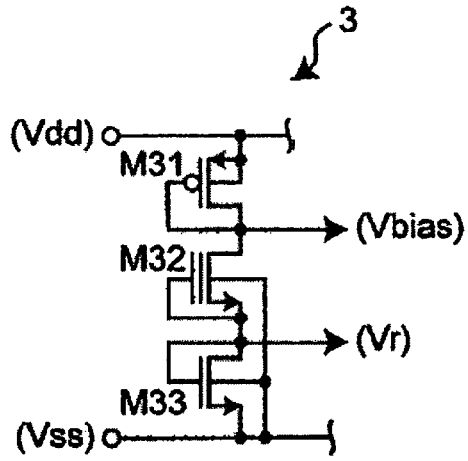
FIG. 5 is a circuit diagram showing a configuration of a reference voltage generation circuit in the constant voltage circuit according to the first embodiment of the present invention.

FIG. 5 is a circuit diagram showing a configuration of the reference voltage generation circuit 3.

Referring to FIG. 5, the reference voltage generation circuit 3 includes a PMOS transistor M31, a depletion-type NMOS transistor M32, and an enhancement-type NMOS transistor M33. The NMOS transistor M32 forms a first transistor, and the NMOS transistor M33 forms a second transistor. The PMOS transistor M31, the NMOS transistor M32, and the NMOS transistor M33 are connected in series between the positive side supply voltage Vdd and the negative side supply voltage Vss, or ground in the case of FIG. 3.

The PMOS transistor M31 has its gate connected to its drain. The NMOS transistor M32 has its gate connected to its source. The NMOS transistor M33 has its gate connected to its drain. The bias voltage Vbias is output from the connection of the PMOS transistor M31 and the NMOS transistor M32. The reference voltage Vr is output from the connection of the NMOS transistors M32 and M33. The PMOS transistor M31 forms a current mirror circuit with each of the PMOS transistors M7, M9, M10, M12, and M15. The PMOS transistors M31, M7, and M10 form a current mirror circuit part.

The NMOS transistors M22 and M24, which are of the same type as but larger in transistor size than the enhancement-type NMOS transistor M33, require a smaller gate-source voltage than the NMOS transistor M33 to cause the same drain current as that of the NMOS transistor M33 to flow. Accordingly, the NMOS transistors M22 and M24 can form detection circuits detecting the second limit voltage Vd and the first limit voltage Vb, respectively.

In the above description, multiple MOS transistors different in transistor size may be employed for a voltage detection circuit detecting the first limit voltage Vb and the second limit voltage Vd so as to detect a decrease in the output voltage with multiple steps. Further, the voltage at the connection of the PMOS transistor M4 and the resistor R3 may be varied with multiple steps. In this case, the output current io can be limited to a characteristic closer to the conventional foldback characteristic.

In the above description, each of the resistors R3 and R4 is formed of a single resistor. Alternatively, each of the resistors R3 and R4 may be formed by connecting multiple resistors in series and connecting a fuse in parallel to each of some or all of the multiple resistors. According to this configuration, each fuse may be selectively cut off by laser trimming so that each of the resistors R3 and R4 can be set to a desired resistance.

Figure 6:
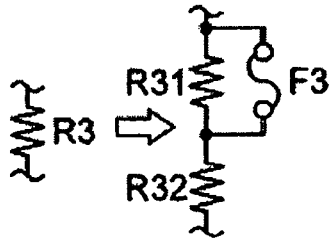
FIG. 6 is a circuit diagram showing another configuration of a resistor R3 in the constant voltage circuit according to the first embodiment of the present invention.
Figure 7:
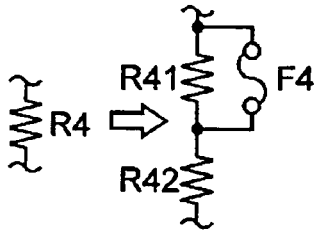
FIG. 7 is a circuit diagram showing another configuration of a resistor R4 in the constant voltage circuit according to the first embodiment of the present invention.

For instance, as shown in FIG. 6, the resistor R3 may be formed of two resistors R31 and R32 connected in series and a fuse F3 connected in parallel to the resistor R31. In this case, the resistance of the resistor R3 may be changed by cutting off the fuse F3. Likewise, for instance, the resistor R4 may be formed of two resistors R41 and R42 connected in series and a fuse F4 connected in parallel to the resistor R41 as shown in FIG. 7. In this case, the resistance of the resistor R4 may be changed by cutting off the fuse F4.

Further, in the above description, each of the NMOS transistors M22 and M24 is formed of a single NMOS transistor. Alternatively, each of the NMOS transistors M22 and M24 may be formed of multiple NMOS transistors and a fuse connected in series to each of some or all of the multiple NMOS transistors. The series circuits of NMOS transistors and corresponding fuses and an NMOS transistor not connected to a fuse, if any, are connected in parallel. According to this configuration, each fuse may be selectively cut off so that each of the NMOS transistors M22 and M24 can be set to a desired current driving capability. This is the same as the changing of the transistor size of each of the NMOS transistors M22 and M24.

Figure 8:
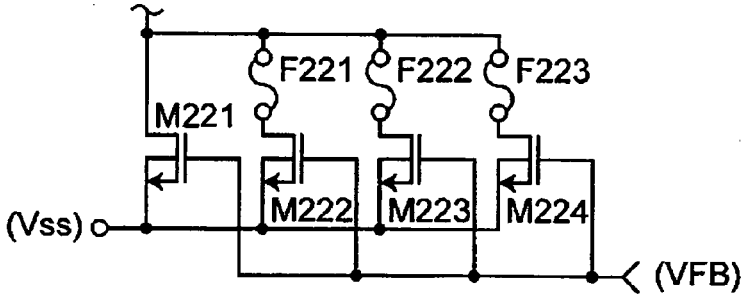
FIG. 8 is a circuit diagram showing another configuration of an NMOS transistor M22 in the constant voltage circuit according to the first embodiment of the present invention.
Figure 9:
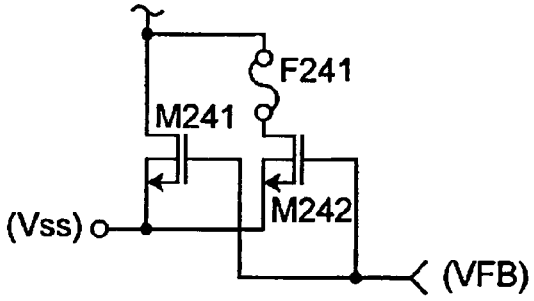
FIG. 9 is a circuit diagram showing another configuration of an NMOS transistor M24 in the constant voltage circuit according to the first embodiment of the present invention.

For instance, as shown in FIG. 8, the NMOS transistor M22 may be formed of NMOS transistors M221 through M224 and fuses F221 through F223 connected in series to the NMOS transistors M222 through M224, respectively. The current driving capability, that is, the transistor size, of the NMOS transistor M22 may be changed by selectively cutting off one or more of the fuses F221 through F223. Further, for instance, the NMOS transistor M24 may be formed of NMOS transistors M241 and M242 and a fuse F241 connected in series to the NMOS transistor M242 as shown in FIG. 9. In this case, the current driving capability, or the transistor size, of the NMOS transistor M24 may be changed by cutting off the fuse F241.

Meanwhile, the threshold voltage of each of the NMOS transistors M22 and M24 may vary depending on temperature. Accordingly, the first limit voltage Vb and the second limit voltage Vd vary. For instance, at high temperatures, the first limit voltage Vb and the second limit voltage Vd decrease, so that the PMOS transistor M1 generates more heat at Point (b) and Point (d) in FIG. 4. This results in a further increase in temperature, so that the first limit voltage Vb and the second limit voltage Vd further decrease. Therefore, the first limit voltage Vb and the second limit voltage Vd may be prevented from being changed by temperature by adjusting a circuit constant so that the temperature dependency of the current flowing through the PMOS transistor M31 and the NMOS transistors M32 and M33 of the reference voltage generation circuit 3 (FIG. 5) is canceled by variations in the threshold voltage and the β value of each of the NMOS transistors M22 and M24 caused by temperature.

For instance, as a result of the flowing of the drain-source current ids of the PMOS transistor M31, which forms a current mirror circuit with the PMOS transistor M10, a drain-source current ids (a constant current) corresponding to the transistor size proportion of the PMOS transistor M10 to the PMOS transistor M31 flows through the PMOS transistor M10. At the same time, a drain-source current ids (a constant current) corresponding to the transistor size proportion of the PMOS transistor M7 to the PMOS transistor M31 flows through the PMOS transistor M7, with which the PMOS transistor M31 forms a current mirror circuit.

When the threshold voltage of the β value of the NMOS transistor M32 varies because of variations in temperature so that the drain-source current ids of the NMOS transistor M32 varies, the drain-source current ids of the PMOS transistor M31 also varies. With this variation, the drain-source current ids of the PMOS transistor M10 also varies in accordance with the transistor size ratio of the PMOS transistor M10 to the PMOS transistor M31, and the drain-source current ids of the PMOS transistor M7 also varies in accordance with the transistor size ratio of the PMOS transistor M7 to the PMOS transistor M31.

Therefore, the voltage level of the divided voltage VFB, based on which the NMOS transistors M25 and M23 are turned on and off, is prevented from depending on temperature by canceling variations in the drain-source currents ids of the PMOS transistors M10 and M7 by variations in the threshold voltages and the β values of the NMOS transistors M24 and M22, respectively, caused by variations in temperature. This makes it possible to prevent the first limit voltage Vb and the second limit voltage Vd from depending on temperature. This can be realized by adjusting the transistor size of each of the NMOS transistors M32, M24, and M22.

Figure 10:
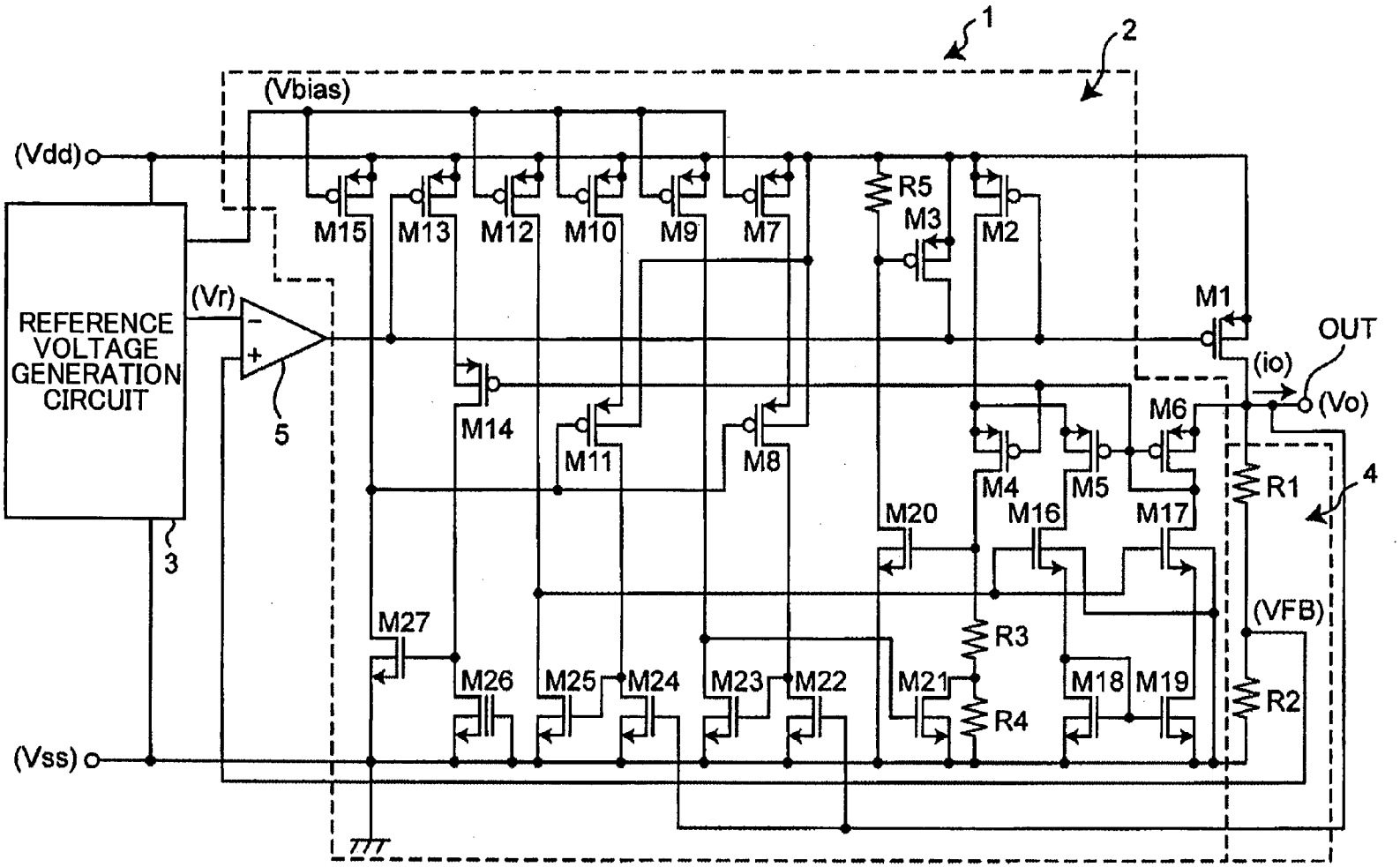
FIG. 10 is a circuit diagram showing a variation of the constant voltage circuit according to the first embodiment of the present invention.

In the above description, the divided voltage VFB is applied to the gate of each of the NMOS transistors M22 and M24. Alternatively, as shown in FIG. 10, the output voltage Vo may be applied to the gate of each of the NMOS transistors M22 and M24.

Thus, according to the constant voltage circuit 1 of the first embodiment, when the output current io reaches the first limit current ia, the overcurrent protection circuit 2 controls the PMOS transistor M1 so that an increase in the output current of the PMOS transistor M1 is controlled so as to reduce the output voltage Vo. When the output voltage Vo is reduced to the predetermined first limit voltage Vb, the NMOS transistor M24 is turned off so that the NMOS transistor M16 is turned off. As a result, the gate voltage of the NMOS transistor M20 increases so as to increase the gate voltage of the PMOS transistor M1, so that the output current io is limited to the second limit current value ic to reduce the output voltage Vo. When the output voltage Vo is reduced to the predetermined second limit voltage Vd, the NMOS transistor M22 is turned off so that NMOS transistor M21 is turned off. As a result, the gate voltage of the NMOS transistor M20 further increases so as to further increase the gate voltage of the PMOS transistor M1, so that the output current io is limited to the third limit current value ie to further reduce the output voltage Vo.

Therefore, a limit current value for the output current io can be varied in a step-like manner so that the combination of the limit current value and the output voltage Vo can be varied in a step-like manner. As a result, the occurrence of oscillation can be prevented and current consumption can be reduced.

In FIG. 4, a smaller voltage difference between a predetermined voltage value Vx of the output voltage Vo at a normal time and the first limit voltage value Vb is better. That is, the greater the first limit voltage value Vb, the better. When the output voltage Vo is reduced with the output current io remaining at the first limit current value ia, a large amount of heat is generated. Therefore, the first limit voltage value Vb is set to a great value so as to obtain the effect of reducing the heat generation. Further, in FIG. 4, in order to reduce heat generation, the second limit voltage value Vd may be reduced without its minimum value that considers ambient temperature and process variations being 0 V. Accordingly, the relationship between the output voltage Vo and the output current io may have a characteristic shown in FIG. 11 instead of the characteristic of FIG. 4.

Figure 11:
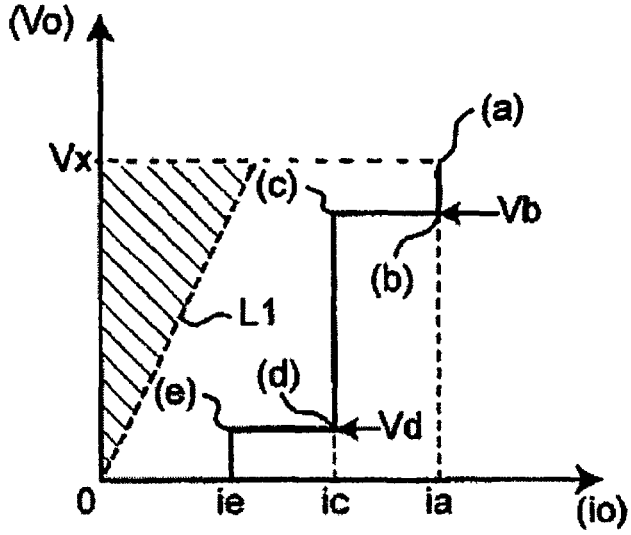
FIG. 11 is a graph-showing another output voltage-current relationship in the constant voltage circuit according to the first embodiment of the present invention.

In order to increase the first limit voltage Vb and decrease the second limit voltage Vd as shown in FIG. 11, any one of the following conditions (I) through (III) should be satisfied or the conditions (I) and (II) should be satisfied.

(I) The NMOS transistor M24 has a higher threshold voltage than the NMOS transistor M22.

(II) The NMOS transistor M24 is smaller in transistor size than the NMOS transistor M22.

(III) The NMOS transistors M22 and M24 have the same threshold value and transistor size. The divided voltage VFB is applied to the gate of the NMOS transistor M24. The output voltage Vo is applied to the gate of the NMOS transistor M22.

Referring to FIG. 11, the characteristic indicated by a broken line is a line connecting the intersection of the maximum value of the output current io and the set value Vx of the output voltage Vo in the specifications of the constant voltage circuit 1 and a point where the output voltage Vo is 0 V and the output current io is 0 A. This line is referred to as a load line L1.

It is preferable to reduce the third limit current value ie in order to reduce heat generation at the time of an output short circuit. However, a reduction in the third limit current value ie results in slower rising at the time of turning on power. Accordingly, the third limit current value ie is set to an optimum value considering package allowable power dissipation.

Figure 12:
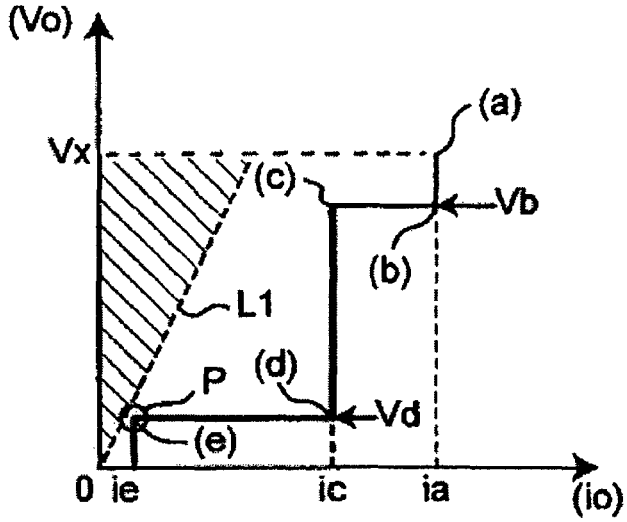
FIG. 12 is a graph showing yet another output voltage-current relationship in the constant voltage circuit according to the first embodiment of the present invention.

The intersection P (FIG. 12) of the second limit voltage value Vd and the third limit current value ie should remain outside the hatched part of FIG. 11. When the maximum value of the output current io in the specifications is used as a resistance load, the output at the time of turning on power rises on the load line L1. Therefore, if the intersection P (FIG. 12) is inside the hatched part of FIG. 11, the output is prevented from rising by the overcurrent protection circuit 2. Accordingly, heat generation can be minimized by setting the second limit voltage value Vd so that the intersection P (FIG. 12) is reduced to a minimum value considering variations in the second limit voltage value Vd considering ambient temperature and process variations.

In order to reduce heat generation at the time of a short circuit when the output voltage Vo becomes 0 V by thus setting the second limit current value Vd, it is preferable that the third limit current value ie be small. By setting the second limit current value Vd to a small value, the third limit current value ie can be further reduced without the intersection P being inside the hatched part of FIG. 11. Further, in the case of a sharp change in the output current io, if the output voltage Vo varies to be temporarily equal to or below the second limit voltage value Vd and the output current io at this point is larger than the third limit current value ie, the output voltage Vo is prevented from returning to the set output voltage of a product. Therefore, if the second limit voltage value Vd can be set to a small value, such a state is less likely to occur, and the constant voltage circuit 1 can be used even when the output current io changes more sharply. Further, the capacity of an external capacitor for stabilizing the output voltage Vo can be reduced. As a result, size and weight reduction can be realized.

Second Embodiment

Figure 13:
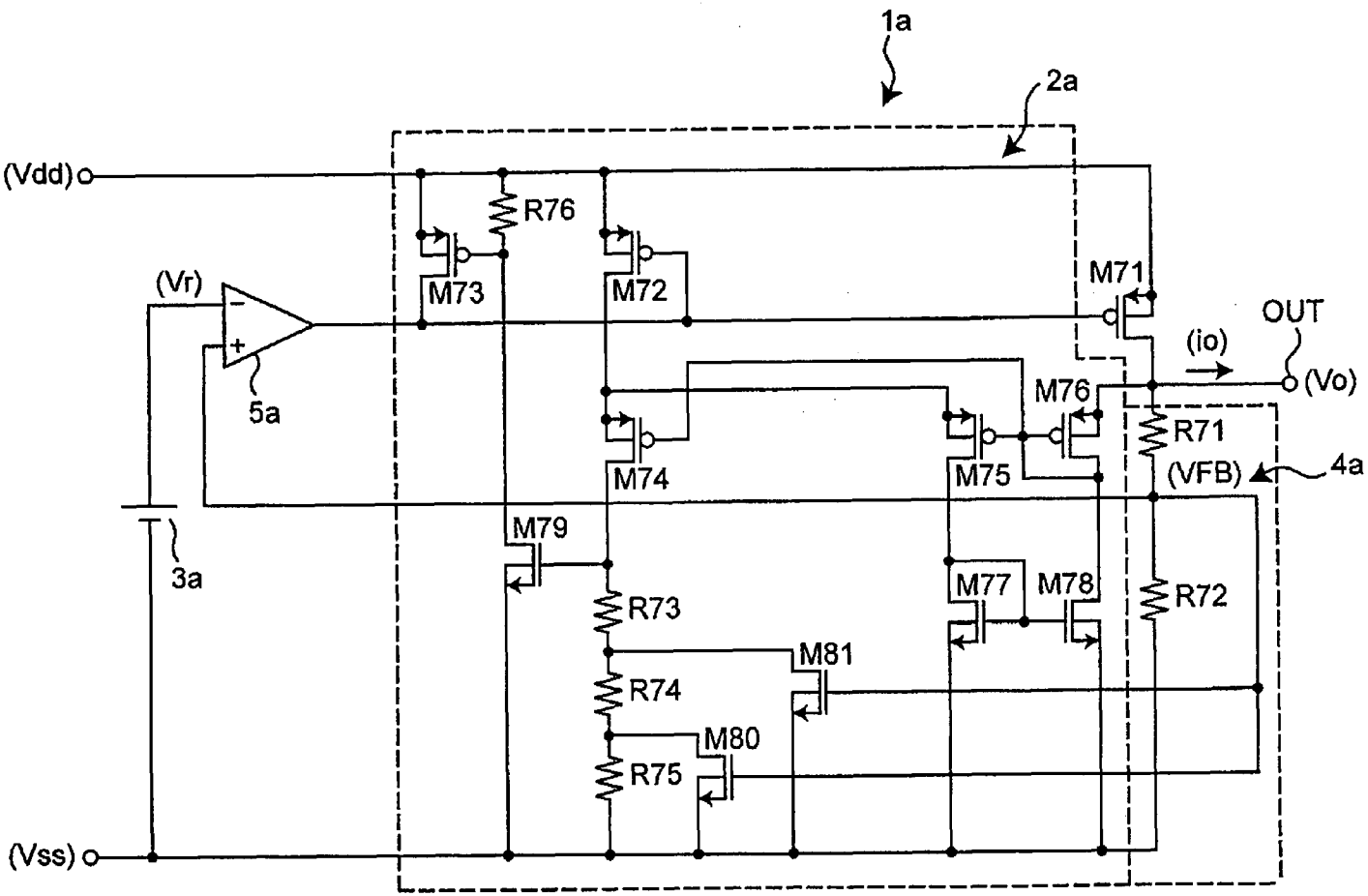
FIG. 13 is a circuit diagram showing a constant voltage circuit according to a second embodiment of the present invention.

FIG. 13 is a circuit diagram showing a constant voltage circuit 1*a* according to a second embodiment of the present invention.

Referring to FIG. 13, the constant voltage circuit 1*a* controls an output current io output from an output terminal OUT so that an output voltage Vo output from the output terminal OUT remains constant at a predetermined voltage. The constant voltage circuit 1*a* includes an overcurrent protection circuit 2*a* for the output current io. The overcurrent protection circuit 2*a* operates so that the relationship between the output voltage Vo and the output current io has a characteristic approximating the conventional foldback characteristic.

The constant voltage circuit 1*a* includes the overcurrent protection circuit 2*a*, a reference voltage generation circuit 3*a* generating and outputting a predetermined reference voltage Vr, an output voltage detection circuit 4*a* dividing the output voltage Vo between resistors R71 and R72 and outputting a resultant divided voltage VFB, an error amplifier 5*a* amplifying and outputting a difference in voltage between the divided voltage VFB output from the output voltage detection circuit 4*a* and the reference voltage Vr, and a PMOS transistor M71 forming a driver transistor controlling the output current io based on the output signal of the error amplifier 5*a* so that the output voltage Vo is controlled to a constant voltage. The overcurrent protection circuit 2*a* includes PMOS transistors M72 through M76, NMOS transistors M77 through M81, and resistors R73 through R76.

The PMOS transistor M71 forms a transistor for output control (an output control transistor). The resistors R71 and R72 form an output voltage detection circuit. The PMOS transistor M72 forms a proportional current generation circuit part and a proportional current generation transistor. The PMOS transistors M74 and M75 form a current division circuit part. The resistors R73 through R75 form a current-voltage conversion circuit part. The PMOS transistor M73, the NMOS transistor M79, and the resistor R76 form an output current control circuit part. The NMOS transistors M80 and M81 form a conversion ratio changing circuit part and a switch element.

The PMOS transistor M71 is connected between a positive side supply voltage Vdd and the output terminal OUT. A series circuit formed of the resistors R71 and R72 is connected between the output terminal OUT and a negative side supply voltage Vss. The connection of the resistors R71 and R72 is connected to the non-inverting input terminal of the error amplifier 5*a*. The reference voltage Vr is applied to the inverting input terminal of the error amplifier 5*a*. The output terminal of the error amplifier 5*a* is connected to the gate of the PMOS transistor M71. The error amplifier 5*a* controls the operation of the PMOS transistor M71 so that the divided voltage VFB obtained by dividing the output voltage Vo between the resistors R71 and R72 is equalized with the reference voltage Vr, thereby controlling the output current io so that the output voltage Vo is controlled to a constant voltage.

The source of the PMOS transistor M72 is connected to the source of the PMOS transistor M71, and the gate of the PMOS transistor M72 is connected to the gate of the PMOS transistor M71. Accordingly, a current proportional to the drain current of the PMOS transistor M71 flows from the drain of the PMOS transistor M72. The drain current of the PMOS transistor M72 is supplied to the source of each of the PMOS transistors M74 and M75 in a current mirror circuit composed of the PMOS transistors M74 and M75 and a PMOS transistor M76. Thus, the drain current of the PMOS transistor M72 is divided into currents proportional to the transistor sizes of the PMOS transistors M74 and M75, and the divided currents are output from the PMOS transistors M74 and M75 as their respective drain currents.

The NMOS transistor M77 is connected between the drain of the PMOS transistor M75 and the negative side supply voltage Vss. The NMOS transistor M78 is connected between the drain of the PMOS transistor M76 and the negative side supply voltage Vss. The gates of the NMOS transistors M77 and M78 are connected. The connection of the gates of the NMOS transistors M77 and M78 is connected to the drain of the NMOS transistor M77. The NMOS transistors M77 and M78 form a current mirror circuit.

The drain current of the PMOS transistor M74, which is one of the divided currents, is supplied to the resistors R73 through R75 connected in series. The connection of the resistor R73 and the drain of the PMOS transistor M74 is connected to the gate of the NMOS transistor M79. When the voltage at the connection of the resistor R73 and the PMOS transistor M74 is equalized with the threshold voltage of the NMOS transistor M79, the NMOS transistor M79 is turned on.

The gate of the PMOS transistor M73 is connected to the positive side supply voltage Vdd via the resistor R76. The gate of the PMOS transistor M73 is connected to the drain of the NMOS transistor M79. Accordingly, when the NMOS transistor M79 is turned on, the PMOS transistor M73 is also turned on. The source of the PMOS transistor M73 is connected to the source of the PMOS transistor M71. The drain of the PMOS transistor M73 is connected to the gate of the PMOS transistor M71. Accordingly, when the PMOS transistor M73 is turned on, the gate voltage of the PMOS transistor M71 is controlled so as to prevent an increase in the output current io so that the output voltage Vo is reduced.

This state is shown as Point (a) in FIG. 4, which shows the relationship between the output voltage Vo and the output current io. That is, when the output current io reaches the first limit current value ia, the NMOS transistor M79 is turned on, and the overcurrent protection circuit 2*a* controls the operation of the PMOS transistor M71 so that the output current io is limited to the first limit current value ia by the PMOS transistor M73. As a result, the output voltage Vo is reduced.

On the other hand, the NMOS transistor M81 is connected in parallel to the series circuit of the resistors R74 and R75, and the divided voltage VFB is applied to the gate of the NMOS transistor M81. The NMOS transistor M80 is connected in parallel to the resistor R75, and the divided voltage VFB is applied to the gate of the NMOS transistor M80. While the constant voltage circuit 1*a* is operating normally, the divided voltage VFB is controlled so as to be equalized with the reference voltage Vr. Accordingly, in this state, the NMOS transistors M80 and M81 are turned on. The divided voltage VFB is reduced with a decrease in the output voltage Vo, and when the output voltage Vo is reduced to the voltage Vb at Point (b) in FIG. 4, the NMOS transistor M81 is turned off. That is, the NMOS transistor M81 forms a transistor for detecting the first limit voltage Vb.

When the NMOS transistor M81 is turned off, the resistors R73 and R74 are connected in series between the gate of the NMOS transistor M79 and ground, so that the gate voltage of the NMOS transistor M79 increases. As a result, the drain current of the NMOS transistor M79 increases to reduce the gate voltage of the PMOS transistor M73. As a result, the gate voltage of the PMOS transistor M71 increases so that the output current io is reduced. This state is shown as Point (c) in FIG. 4. That is, when the output current io reaches the current value ic, the NMOS transistor M81 is turned off, and the overcurrent protection circuit 2*a* controls the operation of the PMOS transistor M71 so that the output current io is limited to the second limit current value ic by the PMOS transistor M73. As a result, the output voltage Vo is reduced.

The NMOS transistor M80 has a larger transistor size or a lower threshold voltage than the NMOS transistor M81. Like the NMOS transistor M81, the NMOS transistor M80 is turned on while the constant voltage circuit 1*a* is operating normally. The divided voltage VFB is reduced with a decrease in the output voltage Vo, and when the output voltage Vo is reduced to the voltage Vd at Point (d) in FIG. 4, the NMOS transistor M80 is turned off. That is, the NMOS transistor M80 forms a transistor for detecting the second limit voltage Vd.

When the NMOS transistor M80 is turned off, the resistors R73 through R75 are connected in series between the gate of the NMOS transistor M79 and ground, so that the gate voltage of the NMOS transistor M79 increases. As a result, the drain current of the NMOS transistor M79 increases to reduce the gate voltage of the PMOS transistor M73. As a result, the gate voltage of the PMOS transistor M71 increases so that the output current io is reduced. This state is shown as Point (e) in FIG. 4.

That is, when the output current io reaches the current value ie, the NMOS transistor M80 is turned off, and the overcurrent protection circuit 2*a* controls the operation of the PMOS transistor M71 so that the output current io is limited to the third limit current value ie by the PMOS transistor M73. As a result, the output voltage Vo is reduced. Thus, when the output current io of the constant voltage circuit 1*a* becomes as large as the first limit current ia, the output voltage Vo and the output current io are reduced in a step-like manner with a characteristic substantially equal to the conventional fold-back characteristic.

Figure 14:
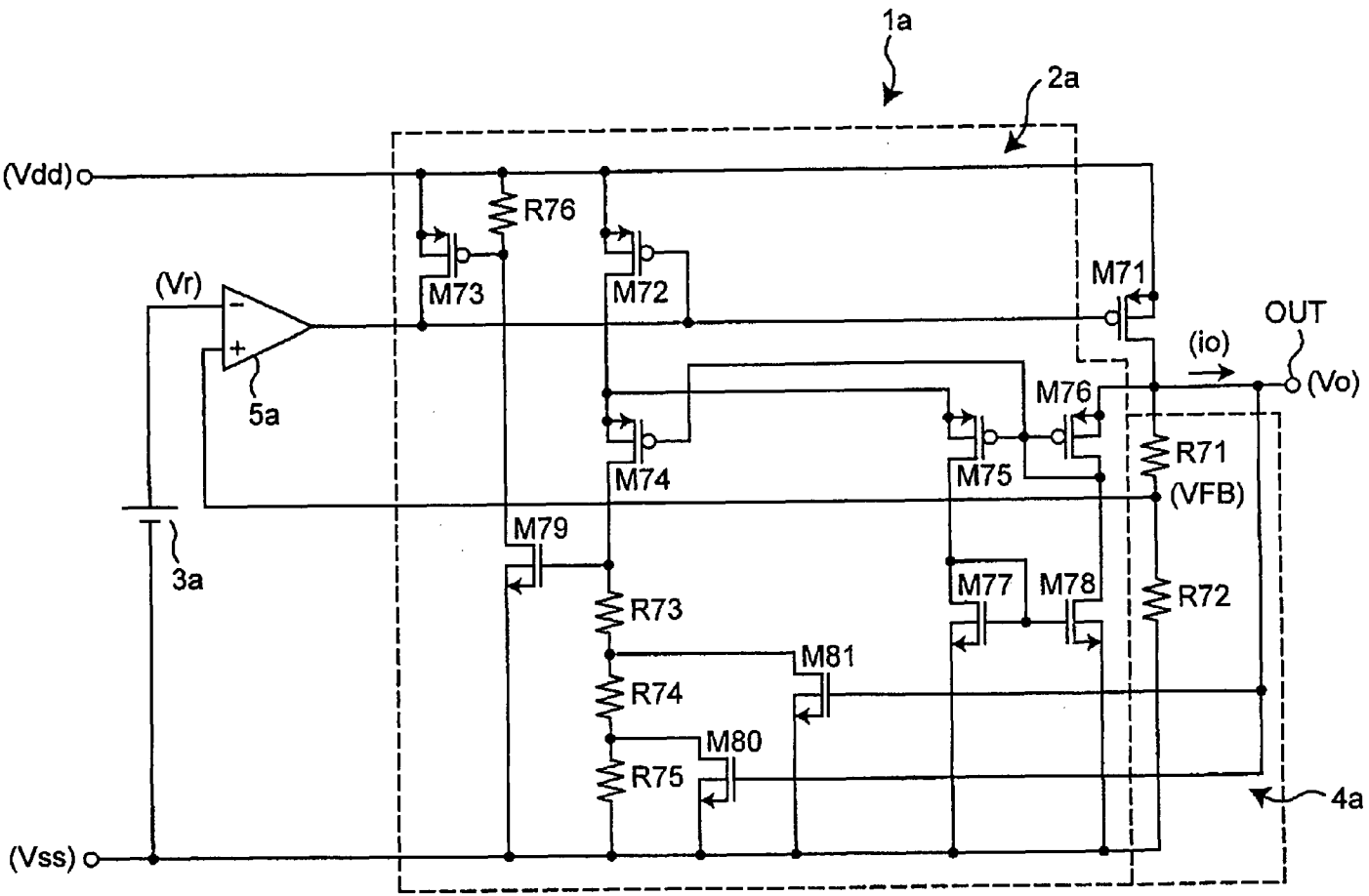
FIG. 14 is a circuit diagram showing a variation of the constant voltage circuit according to the second embodiment of the present invention.
Figure 15:
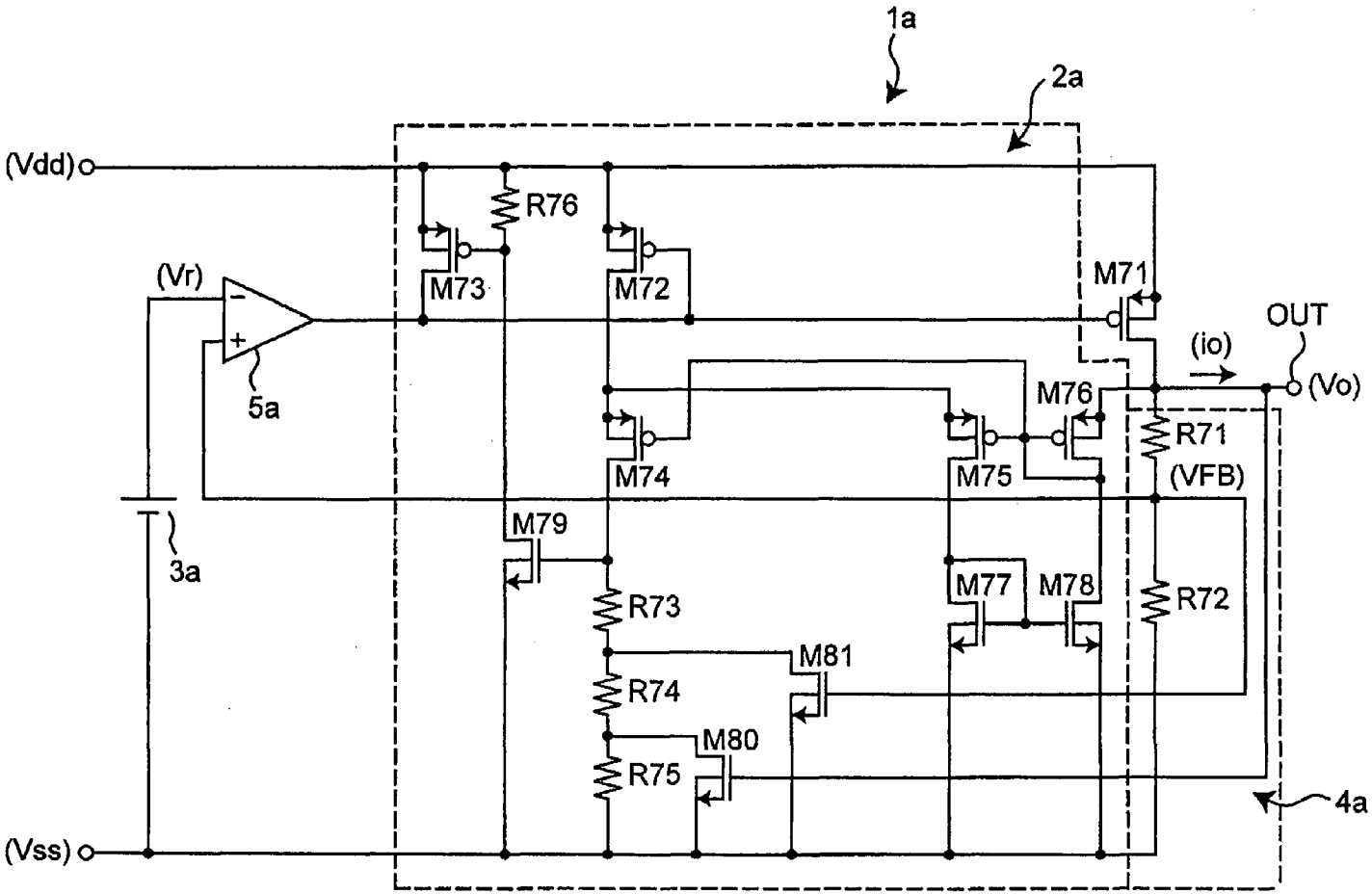
FIG. 15 is a circuit diagram showing another variation of the constant voltage circuit according to the second embodiment of the present invention.

In the above description, the divided voltage VFB is applied to the gate of each of the NMOS transistors M80 and M81. Alternatively, the output voltage Vo may be applied to the gate of each of the NMOS transistors M80 and M81 as shown in FIG. 14. Alternatively, as shown in FIG. 15, the output voltage Vo may be applied to the gate of the NMOS transistor M80, and the divided voltage VFB may be applied to the gate of the NMOS transistor M81.

Further, in the above description, each of the resistors R73 through R75 is formed of a single resistor. Alternatively, like the resistors R3 and R4 shown in FIGS. 6 and 7, each of the resistors R73 through R75 may be formed by connecting multiple resistors in series and connecting a fuse in parallel to each of some or all of the multiple resistors. According to this configuration, each fuse may be selectively cut off by laser trimming so that each of the resistors R73 through R75 can be set to a desired resistance.

Thus, according to the constant voltage circuit 1*a* of the second embodiment, when the output current io reaches the first limit current ia, the overcurrent protection circuit 2*a* controls the PMOS transistor M71 so that an increase in the output current of the PMOS transistor M71 is controlled so as to reduce the output voltage Vo. When the output voltage Vo is reduced to the predetermined first limit voltage Vb, the NMOS transistor M81 is turned off. As a result, the gate voltage of the NMOS transistor M79 increases so as to increase the gate voltage of the PMOS transistor M71, so that the output current io is limited to the second limit current value ic to reduce the output voltage Vo. When the output voltage Vo is reduced to the predetermined second limit voltage Vd, the NMOS transistor M80 is turned off. As a result, the gate voltage of the NMOS transistor M79 further increases so as to further increase the gate voltage of the PMOS transistor M71, so that the output current io is limited to the third limit current value ie to further reduce the output voltage Vo. Thereby, the same effects as in the first embodiment can be produced. Further, the number of transistors forming a circuit can be reduced, so that production costs can be reduced.

Third Embodiment

The first and second embodiments may be combined as one, which is shown as a third embodiment.

Figure 16:
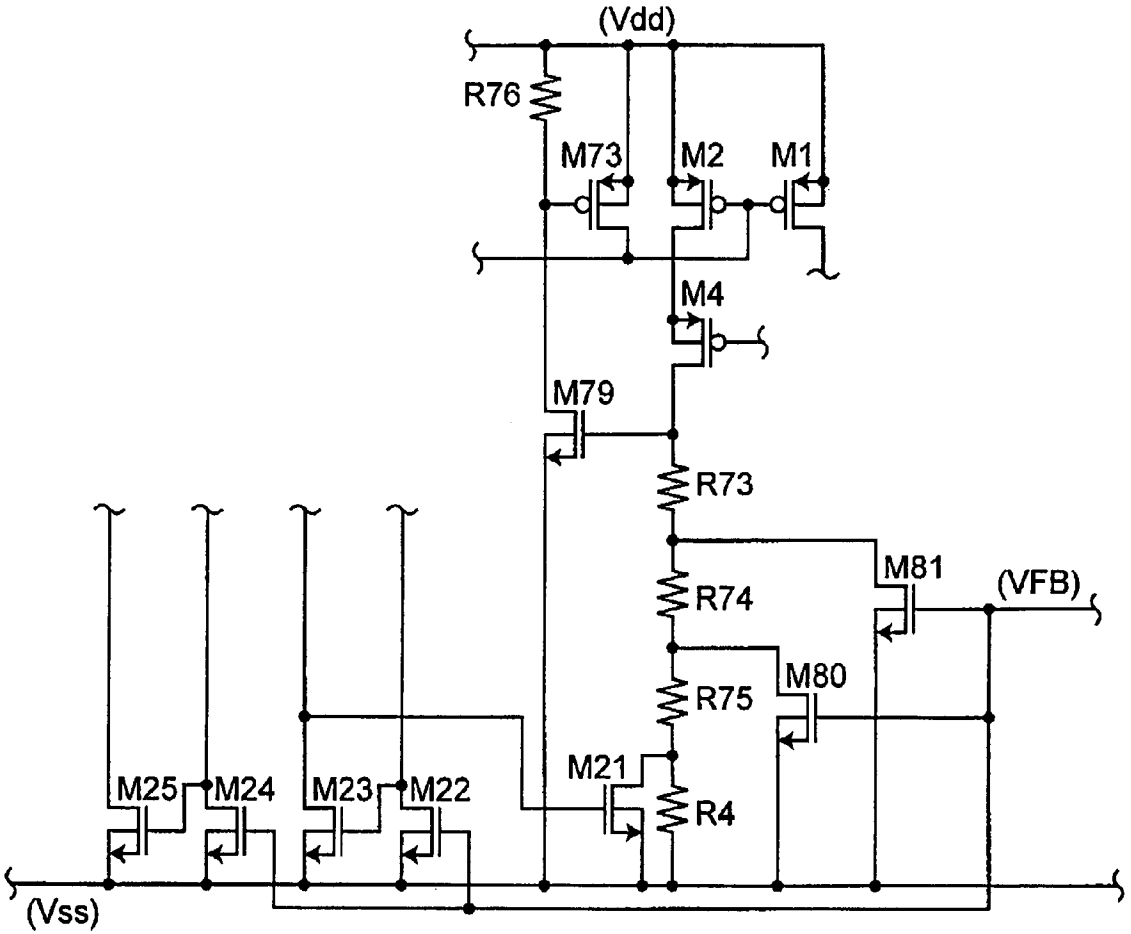
FIG. 16 is a circuit diagram showing part of a constant voltage circuit according to a third embodiment of the present invention.

FIG. 16 is a circuit diagram showing part of a constant voltage circuit 1*b* according to the third embodiment of the present invention. In FIG. 16, the same elements as those of FIGS. 3 and 13 are referred to by the same numerals, and a description thereof is omitted. A description is given below of the differences from FIG. 3, and FIG. 16 shows a circuit part different from FIG. 3.

In FIG. 16, the differences from FIG. 3 lie in that the resistor R3 of FIG. 3 is replaced with the series circuit of the resistors R73 through R75 of FIG. 13 and that the PMOS transistor M3, the NMOS transistor M20, and the resistor R5 are replaced with the PMOS transistor M73, the NMOS transistor M79, and the resistor R76 of FIG. 13. As a result of this change, the overcurrent protection circuit 2 of FIG. 3 is changed to an overcurrent protection circuit 2*b* in the third embodiment, and the constant voltage circuit 1 of FIG. 3 is changed to the constant voltage circuit 1*b* in the third embodiment.

Referring to FIG. 16, the overcurrent protection circuit 2*b* includes the PMOS transistors M2, M4 through M15, and M73, the NMOS transistors M16 through M19, M21 through M27, and M79 through M81, and the resistors R4 and R73 through R76. The PMOS transistor M73, the NMOS transistors M79 through M81, and the resistors R73 through R76 operate in the same manner as in FIG. 13, and the other elements operate in the same manner as in FIG. 3. Therefore, a description of their operations is omitted.

In this configuration, the threshold voltages of the NMOS transistors M22, M24, M80, and M81 are referred to as Vth22, Vth24, Vth80, and Vth81, and the NMOS transistors M22, M24, M80, and M81 are formed so that Vth24>Vth81>Vth80> and Vth22 holds.

Figure 17:
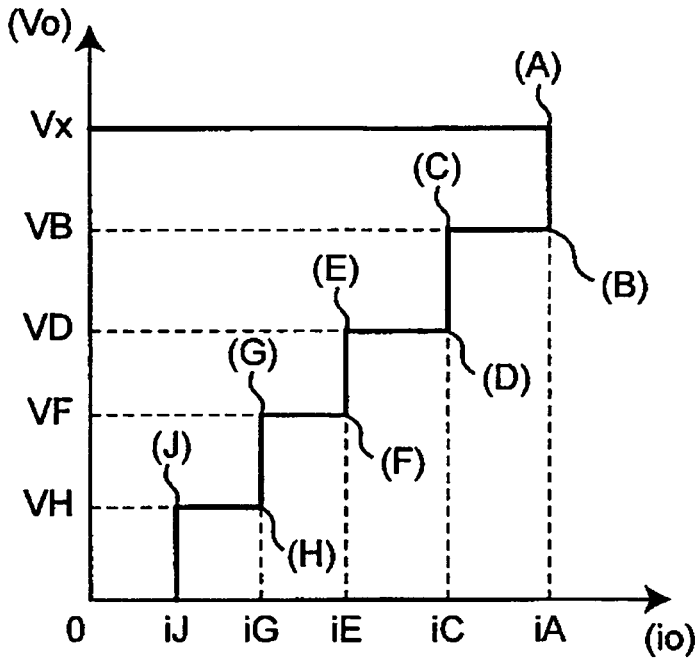
FIG. 17 is a graph showing an output voltage-current relationship in the constant voltage circuit according to the third embodiment of the present invention.

FIG. 17 is a graph showing the relationship between the output voltage Vo and the output current io in FIG. 16.

Referring to FIG. 17, when the output current io reaches a first limit current value iA, the NMOS transistor M79 is turned on, and the overcurrent protection circuit 2*b* controls the operation of the PMOS transistor M1 so that the output current io is limited to the first limit current value iA by the PMOS transistor M73. As a result, the output voltage Vo is reduced. This state is shown as Point (A) in FIG. 17.

The divided voltage VFB is reduced with a decrease in the output voltage Vo, and when the output voltage Vo is reduced to a voltage VB at Point (B) in FIG. 17, the NMOS transistor M24 is turned off. That is, the NMOS transistor M24 forms a transistor for detecting the first limit voltage VB.

When the NMOS transistor M24 is turned off, the NMOS transistor M25 is turned on so that the drain voltage of the NMOS transistor M25 is reduced. As a result, the NMOS transistors M16 and M17 are turned off. When the NMOS transistor M16 is turned off, the current channel of the drain current of the PMOS transistor M5, which divides the drain current of the PMOS transistor M2 proportional to the output current io, is cut off. Accordingly, all the drain current of the PMOS transistor M2 flows into the PMOS transistor M4. As a result, the gate voltage of the NMOS transistor M79 increases so as to increase the drain current of the NMOS transistor M79, so that the gate voltage of the PMOS transistor M73 is reduced. As a result, the gate voltage of the PMOS transistor M1 increases so that the output current io is reduced. This state is shown as Point (C) in FIG. 17.

That is, when the output current io reaches a current value iC, the NMOS transistor M16 is turned off, and the overcurrent protection circuit 2*b* controls the operation of the PMOS transistor M1 so that the output current io is limited to the second limit current value iC by the PMOS transistor M73. As a result, the output voltage Vo is reduced. In this state, the NMOS transistors M80 and M81 are turned on.

The divided voltage VFB is reduced with a decrease in the output voltage Vo, and when the output voltage Vo is reduced to a voltage VD at Point (D) in FIG. 17, the NMOS transistor M81 is turned off. That is, the NMOS transistor M81 forms a transistor for detecting the second limit voltage VD.

When the NMOS transistor M81 is turned off, the resistors R73 and R74 are connected in series between the gate of the NMOS transistor M79 and ground since the NMOS transistor M21 is turned on. As a result, the gate voltage of the NMOS transistor M79 increases. Accordingly, the drain current of the NMOS transistor M79 increases to reduce the gate voltage of the PMOS transistor M73. As a result, the gate voltage of the PMOS transistor M1 increases so that the output current io is reduced. This state is shown as Point (E) in FIG. 17. That is, when the output current io reaches a current value iE, the NMOS transistor M81 is turned off, and the overcurrent protection circuit 2*b* controls the operation of the PMOS transistor M1 so that the output current io is limited to the third limit current value iE by the PMOS transistor M73. As a result, the output voltage Vo is reduced.

The divided voltage VFB is reduced with a decrease in the output voltage Vo, and when the output voltage Vo is reduced to a voltage VF at Point (F) in FIG. 17, the NMOS transistor M80 is turned off. That is, the NMOS transistor M80 forms a transistor for detecting the third limit voltage VF.

When the NMOS transistor M80 is turned off, the resistors R73 through R75 are connected in series between the gate of the NMOS transistor M79 and ground since the NMOS transistor M21 is turned on. As a result, the gate voltage of the NMOS transistor M79 increases. Accordingly, the drain current of the NMOS transistor M79 increases to reduce the gate voltage of the PMOS transistor M73. As a result, the gate voltage of the PMOS transistor M1 increases so that the output current io is reduced. This state is shown as Point (G) in FIG. 17.

That is, when the output current io reaches a current value iG, the NMOS transistor M80 is turned off, and the overcurrent protection circuit 2*b* controls the operation of the PMOS transistor M1 so that the output current io is limited to the fourth limit current value iG by the PMOS transistor M73. As a result, the output voltage Vo is reduced.

The divided voltage VFB is reduced with a decrease in the output voltage Vo, and when the output voltage Vo is reduced to a voltage VH at Point (H) in FIG. 17, the NMOS transistor M22 is turned off. That is, the NMOS transistor M22 forms a transistor for detecting the fourth limit voltage VH.

When the NMOS transistor M22 is turned off, the NMOS transistor M23 is turned on so that the drain voltage of the NMOS transistor M23 is reduced. As a result, the NMOS transistor M21 is turned off. When the NMOS transistor M21 is turned off, the drain current of the PMOS transistor M2, which has flown into the resistors R73 through R75, also flows into the resistor R4. Accordingly, the gate voltage of the NMOS transistor M79 increases so as to increase the gate voltage of the PMOS transistor M1 via the NMOS transistor M79 and the PMOS transistor M73. As a result, the output current io is reduced. This state is shown as Point (J) in FIG. 17.

That is, when the output current io reaches a current value iJ, the NMOS transistor M21 is turned off, and the overcurrent protection circuit 2*b* controls the operation of the PMOS transistor M1 so that the output current io is limited to the fifth limit current value iJ by the PMOS transistor M73. As a result, the output voltage Vo is reduced. Thus, when the output current io of the constant voltage circuit 1*b* becomes as large as the first limit current iA, the output voltage Vo and the output current io are reduced in a step-like manner with a characteristic substantially equal to the conventional foldback characteristic.

In the above description, the divided voltage VFB is applied to the gate of each of the NMOS transistors M80 and M81. Alternatively, the output voltage Vo may be applied to the gate of each of the NMOS transistors M80 and M81. Alternatively, the output voltage Vo may be applied to the gate of the NMOS transistor M80, and the divided voltage VFB may be applied to the gate of the NMOS transistor M81. FIG. 16 shows the case of connecting three resistors in series between the PMOS transistor M4 and the resistor R4. Alternatively, multiple resistors may be connected in series between the PMOS transistor M4 and the resistor R4, and a transistor that controls the connection of the connection part of each resistor and ground in accordance with the number of the resistors may be provided.

Thus, according to the constant voltage circuit 1*b* of the third embodiment, the resistor R3 of the first embodiment is replaced with the series circuit of the resistors R73 through R75 as shown in the second embodiment. Further, the constant voltage circuit 1*b* includes the NMOS transistor M80, which short-circuits the series circuit of the resistor R75 and the resistor R4 in accordance with the output voltage Vo, and the NMOS transistor M81, which short-circuits the series circuit of the resistors R74, R75, and R4 in accordance with the output voltage Vo. As a result, the same effects as in the first embodiment can be produced. Further, the output voltage Vo and the output current io can be reduced with more steps than in the case of FIG. 3, and an overcurrent protection characteristic closer to the conventional foldback characteristic can be obtained.

Thus, according to the present invention, a constant voltage circuit may be provided with an overcurrent protection circuit with the limiting characteristic of an output voltage and current approximating the conventional foldback characteristic, the overcurrent protection circuit achieving low current consumption and being free of unstable operations such as oscillation.

The present invention is not limited to the specifically disclosed embodiments, and variations and modifications may be made without departing from the scope of the present invention.

The present application is based on Japanese Priority Patent Application No. 2003-289101, filed on Aug. 7, 2003, the entire contents of which are hereby incorporated by reference.

What is claimed is:

1. A constant voltage circuit generating and outputting a predetermined constant voltage, the constant voltage circuit having an overcurrent protection function that upon detecting that an output current reaches a predetermined current limit reduces an output voltage and the output current in a step-like manner by alternately reducing the output voltage by a predetermined voltage while maintaining the output current at a present level and then reducing the output current by a predetermined current while maintaining the output voltage at a present level, each reduction step corresponding to a change in output voltage followed by a change in output current, wherein:

when the overcurrent protection function operates, the output voltage and the output current are alternately reduced at different times to reduce heat generation without impacting operating characteristics of the circuit.

2. The constant voltage circuit as claimed in claim 1, wherein when the overcurrent protection function operates, a reduction in the output voltage of a first reduction step is less than a reduction in the output voltage of a subsequent reduction step.

3. A constant voltage circuit generating and outputting a predetermined constant voltage, the constant voltage circuit having an overcurrent protection function that upon detecting that an output current reaches a predetermined current limit reduces an output voltage and the output current in a step-like manner by alternately reducing the output voltage by a predetermined voltage and then reducing the output current by a predetermined current, each reduction step corresponding to a change in output voltage while maintaining the output current at a present level followed by a change in output current while maintaining the output voltage at a present level, wherein:

when the overcurrent protection function operates, a reduction in the output voltage of a first reduction step is less than a reduction in the output voltage of a subsequent reduction step.

* * * * *